US010753554B2

(12) United States Patent
Jiang

(10) Patent No.: US 10,753,554 B2
(45) Date of Patent: Aug. 25, 2020

(54) SLIDE MODEL DESIGN FOR CHANGEABLE SHAPE LED PANEL LIGHT

(71) Applicant: LEDVANCE GmbH, Garching bei München (DE)

(72) Inventor: Tianzheng Jiang, Shenzhen Guangdong (CN)

(73) Assignee: LEDVANCE GMBH, Garching bei München (DE)

( * ) Notice: Subject to any disclaimer, the term of this patent is extended or adjusted under 35 U.S.C. 154(b) by 0 days.

(21) Appl. No.: 16/046,003

(22) Filed: Jul. 26, 2018

(65) Prior Publication Data

US 2019/0032868 A1 Jan. 31, 2019

(30) Foreign Application Priority Data

Jul. 26, 2017 (CN) ..... 2017 1 0619169

(51) Int. Cl.

| | |
|---|---|
| ***F21K 9/20*** | (2016.01) |
| ***F21V 19/00*** | (2006.01) |
| ***F21V 21/26*** | (2006.01) |
| ***F21S 8/06*** | (2006.01) |
| ***F21S 2/00*** | (2016.01) |
| ***F21V 21/005*** | (2006.01) |
| ***F21V 21/22*** | (2006.01) |
| *F21V 17/10* | (2006.01) |
| *F21V 23/06* | (2006.01) |
| *F21Y 115/10* | (2016.01) |
| *F21Y 105/10* | (2016.01) |
| *F21S 6/00* | (2006.01) |
| *F21V 19/02* | (2006.01) |

(52) U.S. Cl.

CPC ..... *F21S 2/005* (2013.01); *F21K 9/20* (2016.08); *F21S 8/06* (2013.01); *F21V 19/0035* (2013.01); *F21V 21/005* (2013.01); *F21V 21/22* (2013.01); *F21V 21/26* (2013.01); *F21S 6/005* (2013.01); *F21V 17/107* (2013.01); *F21V 19/02* (2013.01); *F21V 23/06* (2013.01); *F21Y 2105/10* (2016.08); *F21Y 2115/10* (2016.08)

(58) Field of Classification Search

CPC ..... F21K 9/20; F21S 2/005; F21V 17/107; F21V 19/0035; F21V 21/005; F21V 21/108; F21V 21/22; F21V 21/34; F21V 23/06

See application file for complete search history.

(56) References Cited

U.S. PATENT DOCUMENTS

| | | | | |
|---|---|---|---|---|
| 1,865,179 A * | 6/1932 | Egli | F21V 21/22 | 248/125.2 |
| 2,352,496 A * | 6/1944 | Rose | F21V 21/14 | 211/173 |
| 6,416,207 B1 * | 7/2002 | Chang | F21S 6/003 | 362/249.07 |
| 6,450,668 B1 * | 9/2002 | Kotloff | F21S 8/06 | 362/221 |

(Continued)

*Primary Examiner* — Leah Simone Macchiarolo
(74) *Attorney, Agent, or Firm* — Hayes Soloway PC

(57) ABSTRACT

A lighting device includes a primary lighting module with one or more light sources and one or more secondary lighting modules each with one or more light sources. Each secondary lighting module is mechanically and electrically connected to the primary lighting module. At least one of the secondary lighting modules is movable with respect to the primary lighting module. The shape of the lighting device can be varied between different configurations.

24 Claims, 5 Drawing Sheets

(56) References Cited

U.S. PATENT DOCUMENTS

| | | | | |
|---|---|---|---|---|
| 9,383,508 | B2 * | 7/2016 | Getzinger | G02B 6/0088 |
| 2006/0291204 | A1 * | 12/2006 | Marka | F21S 2/005 362/239 |
| 2008/0170398 | A1 * | 7/2008 | Kim | F21V 21/002 362/260 |
| 2008/0212329 | A1 * | 9/2008 | Duguay | F21S 8/086 362/310 |
| 2012/0140473 | A1 * | 6/2012 | Chang | F21S 2/005 362/249.03 |
| 2012/0140474 | A1 * | 6/2012 | Jurik | F21S 2/00 362/249.09 |
| 2012/0300437 | A1 * | 11/2012 | Lu | F21V 21/005 362/147 |
| 2013/0141914 | A1 * | 6/2013 | Lai | F21V 21/22 362/249.03 |
| 2015/0354794 | A1 * | 12/2015 | Guercio | F21V 21/30 362/235 |
| 2017/0216616 | A1 * | 8/2017 | Boyajian | A61N 5/062 |
| 2018/0324924 | A1 | 11/2018 | Van De Sluis et al. | |
| 2019/0032892 | A1 | 1/2019 | Lin | |

* cited by examiner

SLIDE MODEL DESIGN FOR CHANGEABLE SHAPE LED PANEL LIGHT

CROSS-REFERENCE TO RELATED APPLICATIONS AND PRIORITY

This patent application claims priority from Chinese Patent Application No. 2017106191699 filed Jul. 26, 2017, which is herein incorporated by reference in its entirety.

TECHNICAL FIELD

The present invention relates to a lighting device having a variable shape.

BACKGROUND

Currently, light panels are used for illumination purposes. Light panels usually are square or rectangular, flat lighting devices using a plurality of LEDs over the surface of the light panel, normally covered by a flat diffusing cover. Typical available dimensions are 600 mm×600 mm, 600 mm×1200 mm, and 300 mm×300 mm.

However, such light panels are fixed devices, which can be fixedly installed and might be suitable for general room illumination due to their dimensions, but they cannot be used for purposes where varying lighting configurations are required.

SUMMARY OF THE INVENTION

In view of the known prior art, it is an object of the present invention to provide a lighting device that may flexibly be adapted to suit variable illumination requirements.

This object is solved by a lighting device according to the independent claim. Preferred embodiments are given by the dependent claims.

A lighting device according to the present invention comprises a primary lighting module and one or more secondary lighting modules. The lighting device may comprise 1, 2, 3, 4, 5, 6, 7, 8 or more secondary light sources. Preferably, the secondary lighting modules surround the primary lighting module. The secondary lighting modules can have the same or different sizes and/or shapes. The size and/or shape of the primary lighting module may be different from some or all of the secondary lighting modules. The shape of the lighting modules may be the shape of a square, a rectangle, a hexagon, any other polygon, a circle, combinations thereof, etc.

The primary lighting module and each of the secondary lighting modules comprises one or more light sources. While any known light source may be employed, using semiconductor light sources, for example LEDs, is especially preferred. The light sources of each lighting module (primary and secondary) may be mounted in the lighting module individually or as a unit, e.g. using a carrier carrying the light sources, for example on a printed circuit board (PCB). In particular, light panels, as mentioned above, may be used for the primary and secondary lighting modules.

Each secondary lighting module is mechanically and electrically connected to the primary lighting module. The primary lighting module may comprise an attachment structure for attaching the lighting device to a holder, for example a stand for a standing lamp or a hanging mount for a ceiling lamp. The mechanical connection between primary lighting module and secondary lighting module(s) thus also achieves a mounting of the secondary lighting module(s).

The primary lighting module may comprise electrical connectors (e.g. terminals or cables) for supplying the lighting device with electrical power. The electrical power can be transferred to the secondary lighting module(s) via the electrical connection(s).

An electronic driver (if necessary) may be provided in the primary lighting module, such that electrical power with the required operating parameters (e.g. voltage, current) can be provided via the electrical connections. An electronic driver may also be provided in each of the primary and secondary lighting modules, such that electrical mains power is provided via the electrical connections and electrical power with the required operating parameters is provided for each lighting module by the respective driver.

At least one (and preferably all) of the secondary lighting modules is movable with respect to the primary lighting module. The secondary lighting module may be translationally and/or rotationally movable with respect to the primary lighting module. For example, a secondary lighting module may be movable between a first position close to the primary lighting module and a second position apart from the primary lighting module. A secondary lighting module may also be movable between a first rotational orientation with respect to the primary lighting module and a second rotational orientation with respect to the primary lighting module. A possible rotational orientation is that the primary lighting module and the secondary lighting module are co-planar or parallel. Another possible rotational orientation is that the primary lighting module and the secondary lighting module are arranged with an angle (other than 0° and 180°) therebetween.

If more than one secondary lighting module is used, each secondary lighting module may be moved individually. Alternatively, the movement of the secondary lighting modules may be synchronized, e.g. by a synchronization mechanism.

Different secondary lighting modules may have different degrees of freedom for their movement. For example, they may be movable in different directions and/or they may be movable for different distances.

In an embodiment, the at least one secondary lighting module is connected to the primary lighting module using a connecting module. The connecting module allows a translational and/or rotational movement of the secondary lighting module with respect to the primary lighting module.

The connecting module also provides an electrical connection between the primary lighting module and the secondary lighting module.

In an embodiment, the connecting module comprises a sliding element attached to the secondary lighting module and a slide track attached to the primary lighting module. The slide track is adapted to slidingly receive the sliding element. Sliding the sliding element along the slide track causes a translational movement of the secondary lighting module attached to the sliding element with respect to the primary lighting module, which is attached to the slide track.

The slide track may surround the sliding element on all lateral sides (lateral with regard to the sliding direction) or the slide track may be open on one or more sides. The inner walls of the slide track, which guide the sliding element, may further comprise guiding features, such as grooves, ridges, and/or protrusions, which are adapted to interact with corresponding features (grooves, ridges, and/or protrusions) on the sliding element.

In an embodiment, the sliding element and the slide tracks comprise stoppers adapted to interact with each other in order to limit the range of relative movement between the primary lighting module and the at least one secondary lighting module. Such stoppers may prevent the sliding element from leaving the slide tracks and, thus, the lighting device from falling apart. The stoppers may comprise one or more protrusions on each sliding element and on the corresponding slide track adapted to abut each other at the end of the designed motion range. A protrusion on a slide track may be formed by an end wall of the slide track.

A secondary lighting module may be held in its position relative to the primary lighting module by frictional forces between the sliding element and the slide track.

Alternatively and/or additionally, the connecting module may comprise a locking element for locking the sliding element with respect to the slide track. The locking element may be a stopper screw in a wall of the slide track, which is adapted to be screwed inwards in order to be pushed against the sliding element and, thus, prevent the sliding element from moving.

In an embodiment, the sliding element comprises a first portion and a second portion, wherein the second portion is rotatable with respect to the first portion. Preferably, the sliding element comprises a hinge, which connects the first portion and the second portion rotatably. Preferably the hinge is dimensioned such that it can be received in the slide track. This allows that the first portion as well as the second portion may be received in the slide track. Once the sliding element is moved along the slide track so far that the second portion and hinge are located outside the slide track while the first portion remains at least partially in the slide track, the second portion of the sliding element and the secondary lighting module attached to the second portion may be rotated with respect to the first portion and, thus, to the primary lighting module.

Preferably, the hinge comprises a single rotation axis and allows a relative rotation between first portion and second portion around said rotation axis. Alternatively, the hinge may comprise a ball joint, allowing free rotation of the first portion with respect to the second portion.

A secondary lighting module may be held in its rotational position relative to the primary lighting module by frictional forces between the first portion of the sliding element and the second portion of the sliding element. Alternatively and/or additionally, the first portion of the sliding element (in particular the hinge part of the first portion) and the second portion of the sliding element (in particular the hinge part of the second portion) comprise corresponding latching elements for securing the relative rotational position between the first portion of the sliding element and the second portion of the sliding element. The latching elements may comprise corresponding protrusions and indentations. The protrusions may comprise ribs, preferably arranged around the axis of rotation and the indentations may comprise corresponding grooves, also preferably arrange around the axis of rotation. The protrusions may be located at the hinge part of the first portions and the indentations may be located at the hinge part of the second portion, or vice versa.

In an embodiment, the connecting module further comprises an electrical connector for providing an electrical connection between both ends of the connecting module, in particular for providing an electrical connection between the sliding element and the sliding track.

Preferably, the electrical connector comprises a cable having at least one length varying section allowing longitudinal extension and retraction of the cable. A length varying section thus allows a movement of the sliding element with respect to the slide track, such that an electrical connection may be provided in all relative positions between primary lighting module and secondary lighting module.

The electrical connector may comprise a first length varying section for allowing longitudinal movement of the sliding element along the slide track and a second length varying section for allowing rotational movement of the first portion of the sliding element with respect to the second portion of the sliding element. Alternatively, a single length varying section may be used to accommodate for both types of movement.

A length varying section may comprise a helical cable portion and/or a retractable cable unit. A helical cable portion preferably may be extended from a first length to a second length, wherein the helical cable portion in the extended state exerts an elastic retraction force, biasing the helical cable portion toward a non-extended state.

A retractable cable unit preferably may comprise a spring-loaded mechanism onto which a portion of the cable may be wound. When a pulling force act on the ends of the cable portion, the spring-loaded mechanism rotates (thereby tensioning the spring) and allows the cable to unwind. When the pulling force is released, the loaded spring causes a rotation in the other direction and rewinds the cable.

In an embodiment, the electrical connector comprises one or more fasteners for fastening the electrical connector to the sliding element and/or to the slide track. These fasteners may keep certain portions of the electrical connector in their specified positions. A fastener may be fixedly attached to the electrical connector and may comprise a groove. Such a fastener may be attached to a wall of the sliding element or the slide track.

In an embodiment, the at least one secondary lighting module is movable between a collapsed state of the lighting device and an expanded state of the lighting device. "Collapsed state" herein means that the secondary lighting module(s) is/are in the position closest to the primary lighting module. "Expanded state" herein means that the secondary lighting module(s) is/are in the position furthest apart from the primary lighting module.

The shapes of the primary lighting module and of the at least one secondary lighting module may be designed such that the primary lighting module and the at least one secondary lighting module abut each other in the collapsed state of the lighting device without any gaps therebetween. Such a configuration also allows for keeping the overall dimensions of the lighting device in the collapsed state small.

BRIEF DESCRIPTION OF THE DRAWINGS

Preferred embodiments of the invention will be explained in the following, having regard to the drawings. It is shown in.

DETAILED DESCRIPTION OF THE INVENTION

In the following, preferred embodiments of the invention will be described with reference to the drawings. The same or similar elements or elements having the same effect may be indicated by the same reference number in multiple drawings. Repeating the description of such elements may be omitted in order to prevent redundant descriptions.

Figure 1:
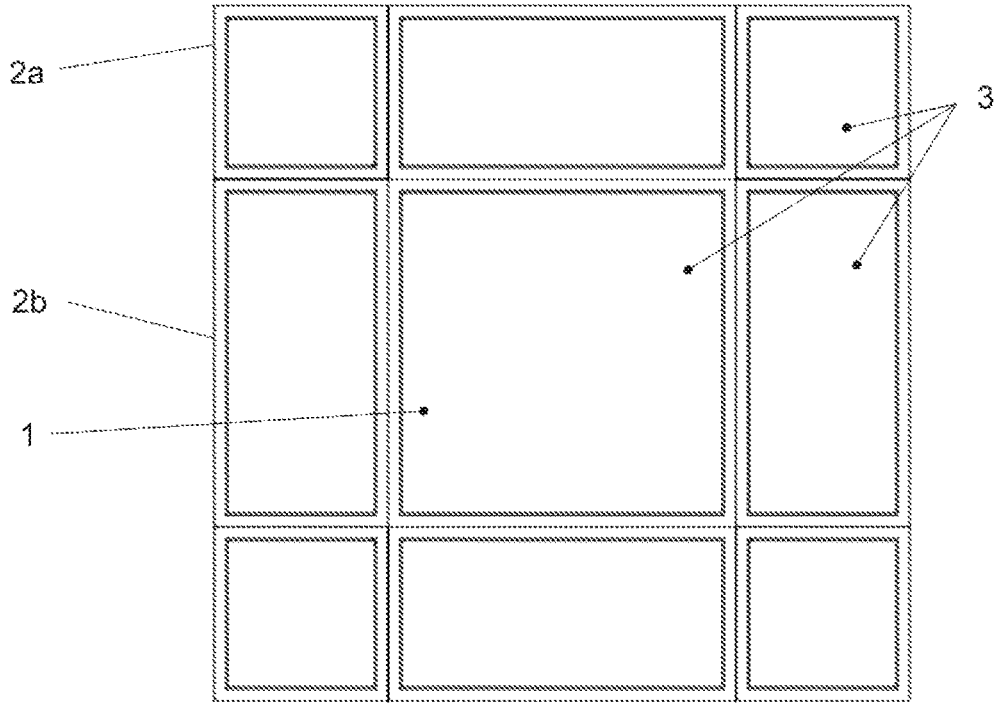
FIG. 1 a schematic view from below of an embodiment of a lighting device according to the present invention in a first configuration.

FIG. 1 shows an embodiment of a lighting device, for example a ceiling lamp, having a variable shape according to the present invention in a collapsed state, i.e. in a first configuration.

The lighting device comprises a primary lighting module 1 and eight secondary lighting modules 2*a*, 2*b*. Four secondary lighting modules 2*a* have a square shape and four secondary lighting modules 2*b* have a rectangular shape. The view of FIG. 1 shows the light emitting side of the lighting modules 1, 2*a*, 2*b*, i.e., the lower side of the lighting device when it is attached to a ceiling.

Each lighting module 1, 2*a*, 2*b* is essentially a light panel, i.e. it comprises multiple light emitting diodes (LEDs, not shown) that may be provided on a PCB (not shown) in a housing. The LEDs may be covered by a diffusing cover 3 in order to achieve smooth illumination.

Figure 2:
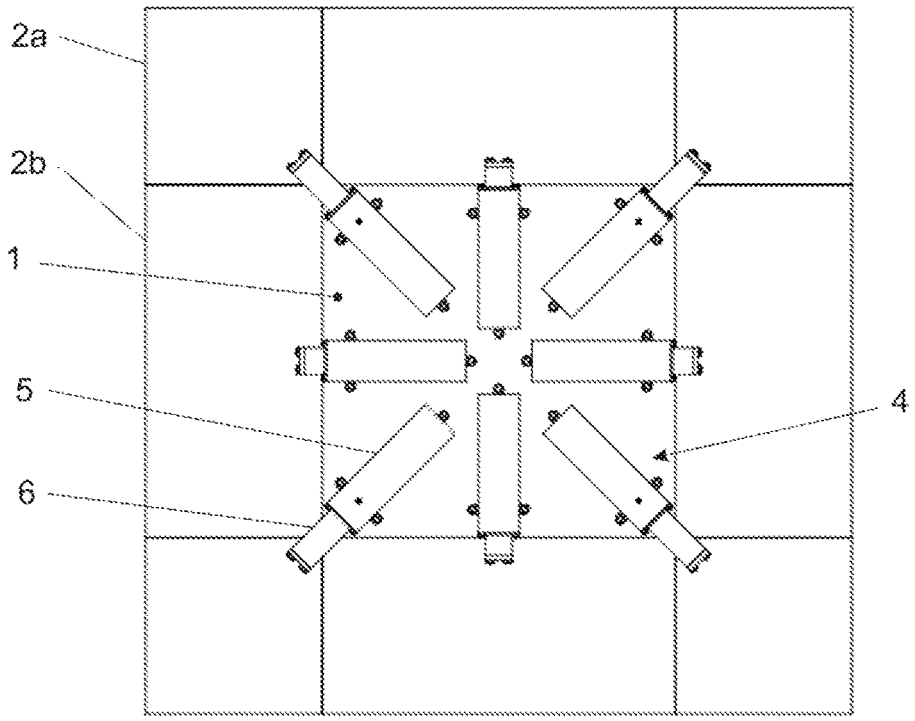
FIG. 2 a schematic view from above of the embodiment of a lighting device shown in FIG. 1 in the first configuration.

FIG. 2 shows the lighting device of FIG. 1 as seen from the opposite (non-light emitting) side, i.e. the upper side of the lighting device when it is attached to a ceiling.

Each secondary lighting module 2*a*, 2*b* is mechanically and electrically connected to the primary lighting module 1 by means of a connecting module 4, which will be explained in detail with regard to FIGS. 5 to 9. Each connecting module 4 comprises a slide track 5 that is attached to the primary lighting module 1 and a sliding element 6 that is attached to one of the secondary lighting modules 2*a*, 2*b*.

The connecting modules 4 allow a translational and rotational movement of the secondary lighting modules 2*a*, 2*b* with respect to the primary lighting module 1. Thus a variety of configurations of the lighting device may be obtained and can be chosen by a user.

Figure 3A:
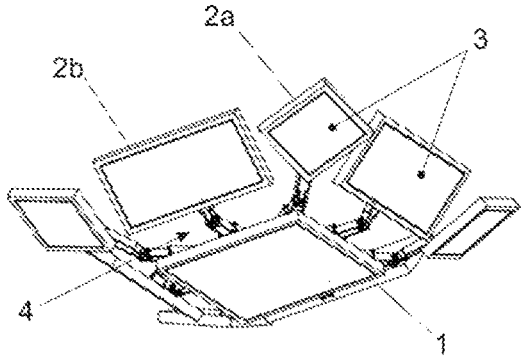
FIGS. 3*a* and 3*b* schematic perspective views of the embodiment shown in the previous drawings in a second configuration.
Figure 3B:
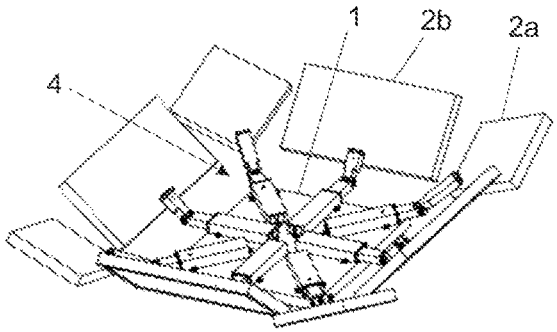

A first configuration where the lighting device is essentially flat, i.e., the primary lighting module 1 and the secondary lighting modules 2*a*, 2*b* are essentially coplanar, has been explained with regard to FIGS. 1 and 2. A second configuration is shown in FIGS. 3*a* and 3*b*. Here, the secondary lighting modules 2*a*, 2*b* are translationally moved away from the primary lighting module 1 by extending the connecting modules 4 and are rotated upwards (assuming the direction of light emission of the primary lighting module 1 to be downwards) by rotating a second portion 8 of the sliding element 6 with respect to a first portion 7 of the same sliding element 6. In this second configuration, the light emission of the lighting device is more divergent than in the first configuration of FIGS. 1 and 2.

Figure 4A:
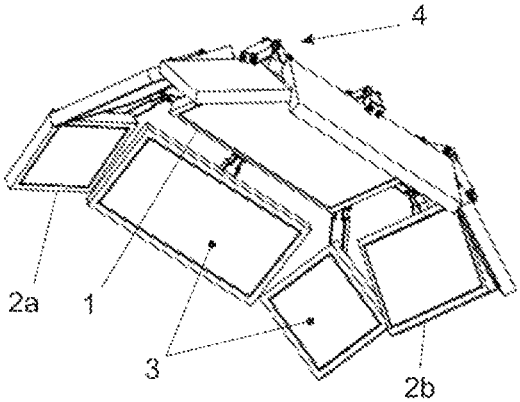
FIGS. 4*a* and 4*b* schematic perspective views of the embodiment shown in the previous drawings in a third configuration.
Figure 4B:
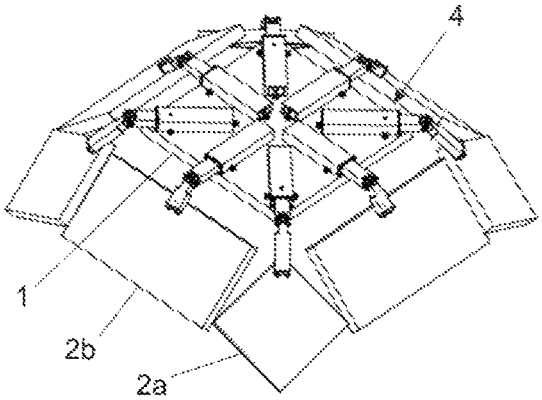
Figure 5:
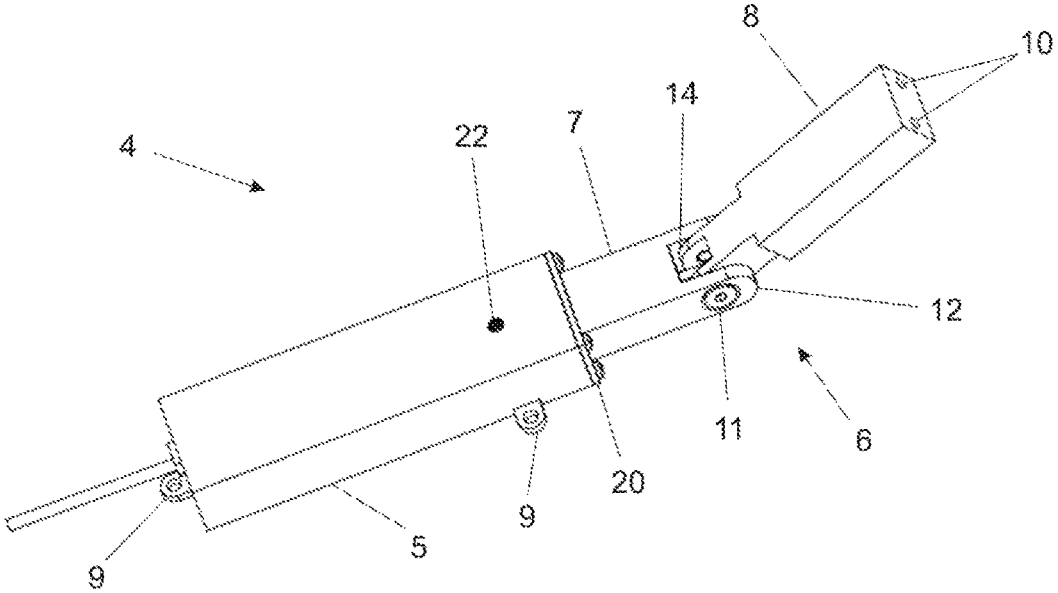
FIG. 5 a schematic perspective view of an embodiment of a connecting module according to the present invention.
Figure 6:
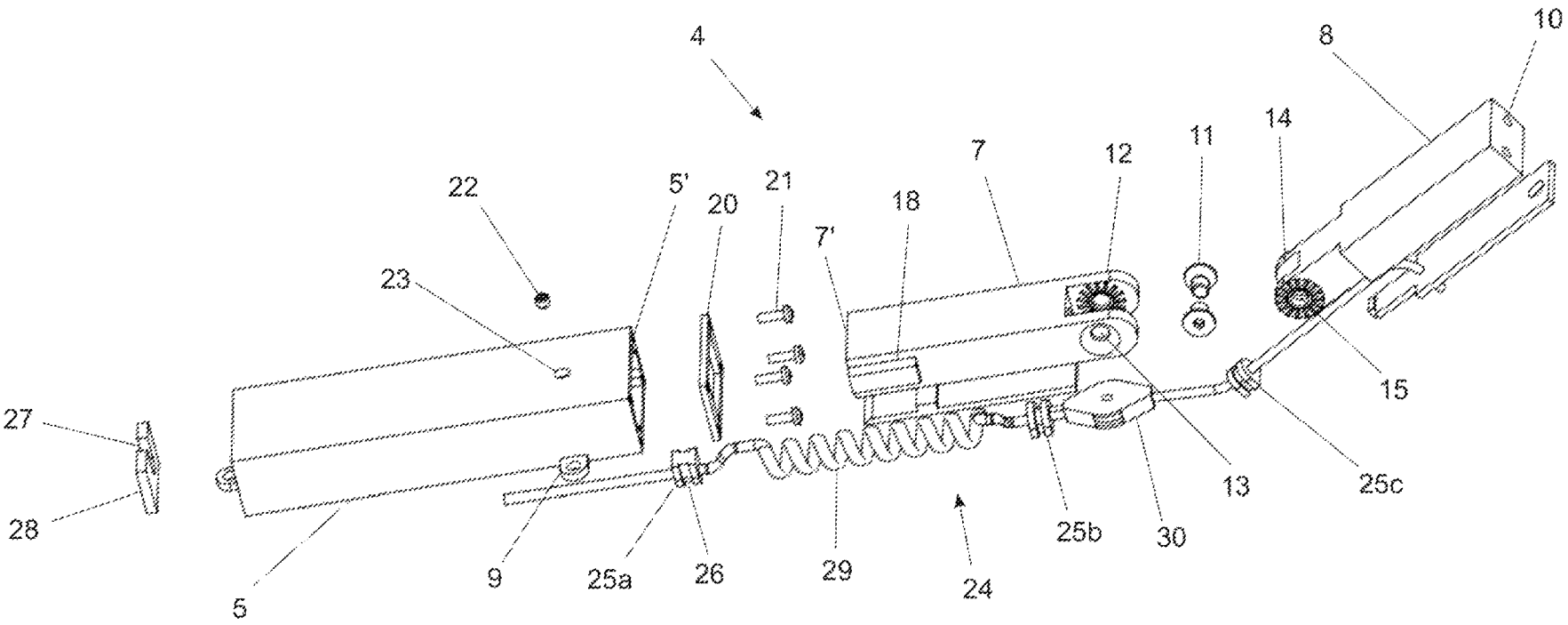
FIG. 6 a schematic exploded view of the embodiment of a connecting module shown in FIG. 5.
Figure 7:
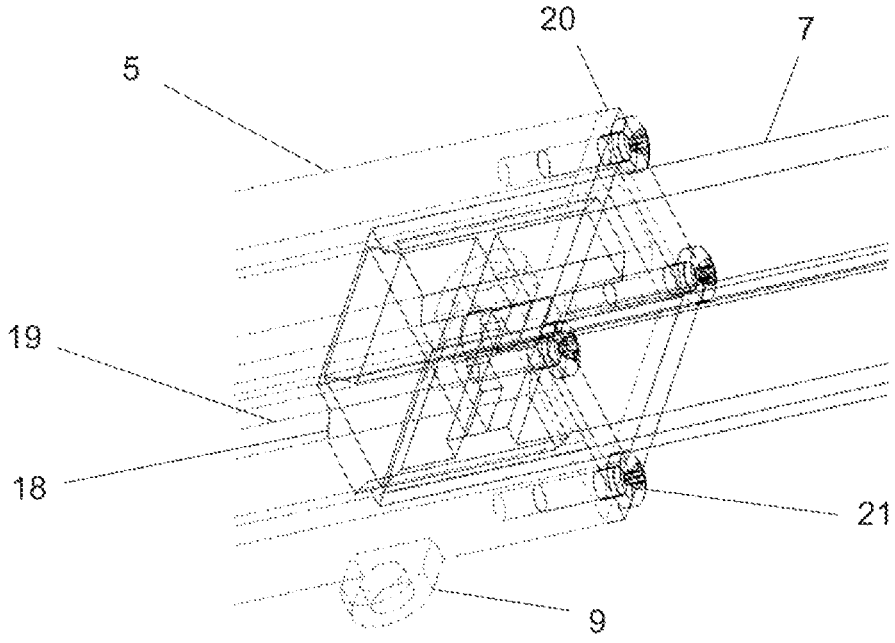
FIG. 7 a partially transparent schematic perspective view of a detail of the embodiment of a connecting module shown in the previous drawings.

A third configuration is shown in FIGS. 4*a* and 4*b*. Here, the secondary lighting modules 2*a*, 2*b* are translationally moved away from the primary lighting module 1 by extending the connecting modules 4 and are rotated downwards (assuming the direction of light emission of the primary lighting module 1 to be downwards) by rotating a second portion 8 of the sliding element 6 with respect to a first portion 7 of the same sliding element 6. In this third configuration, the light emission of the lighting device is more convergent than in the first configuration of FIGS. 1 and 2.

The connecting module 4 will now be explained in detail with regard to FIGS. 5 to 9. Each connecting module 4 comprises a slide track 5 that can be attached to the primary lighting module 1 by eyelets 9 fixed on or unitary with the outside of the slide track housing. For example, screws through the eyelets 9 may be used for attaching the slide track 5 to the primary lighting module 1. Each connecting module 4 further comprises a sliding element 6 that provides screw holes 10 (preferably threaded) for attaching the sliding element to one of the secondary lighting modules 2*a*, 2*b* using screws. The secondary lighting module 2*a*, 2*b* may be provided with an angular attachment element through which the screw can extend into the screw holes 10.

The sliding element 6 comprises a first portion 7 and a second portion 8 which are connected to each other with a hinge. The hinge is formed by a first hinge portion on the first portion 7 of the sliding element 6 and a second hinge portion on the second portion 8 of the sliding element 6, wherein the first hinge portion and the second hinge portion a rotationally coupled by an axis. The axis may comprise two separate screws 11 as shown in the drawings or it may comprise a single screw or other axis.

Figure 8A:
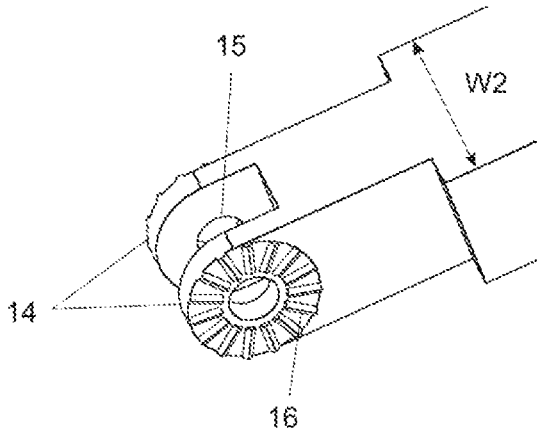
FIGS. 8*a* and 8*b* a perspective view of another detail of the embodiment of a connecting module shown in the previous drawings.
Figure 8B:
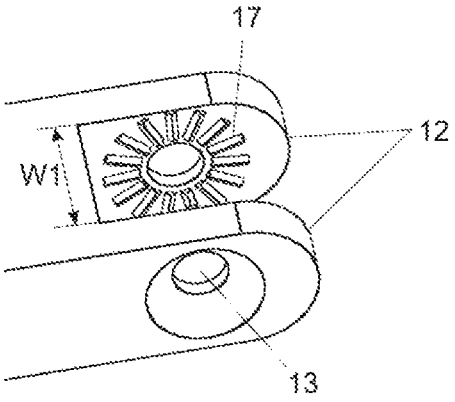
Figure 9:
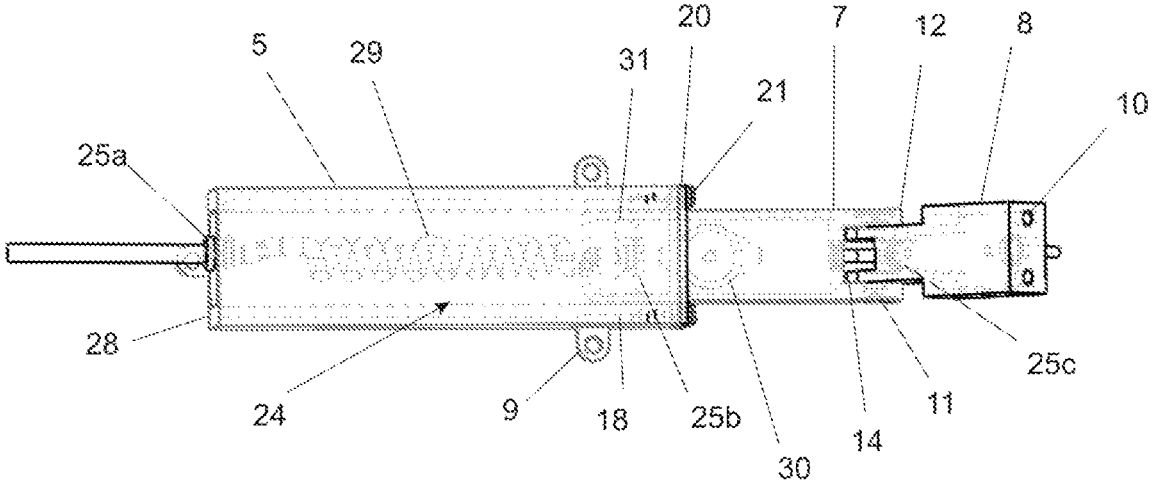
FIG. 9 a partially transparent schematic top view of the embodiment of a connecting module shown in the previous drawings.

The first hinge portion is shown in detail in FIG. 8*b*. The first hinge portion may comprise two essentially parallel first hinge walls 12 leaving therebetween a space with an inner width W1 for receiving the second hinge portion. Openings 13 may be provided in the hinge walls for receiving the axis, in particular the two screws 11 forming the axis. The openings 13 may be tapered at the outer side of the hinge walls 12 for accommodating the heads of the screws 11.

The second hinge portion is shown in detail in FIG. 8*a*. The second hinge portion may comprise two essentially parallel second hinge walls 14 leaving therebetween an open space. Alternatively, the space between the hinge wall may be filled, i.e., the second hinge portion may be constructed solidly. The outer width W2 of the second hinge portion corresponds essentially to (or is slightly smaller than) the inner width W1 of the first hinge portion. Openings 15 may be provided in the hinge walls for receiving the axis, in particular the two screws 11 forming the axis. The openings 15 may be threaded (not shown) to accommodate the thread of the screws 11 and, thus, keep the screws 11 in place.

Latching ribs 16 may be formed on the outside of the second hinge portion (e.g. on the outside of each second hinge wall 14) surrounding the opening 15, each latching rib 16 extending radially from the opening 15. Corresponding latching grooves 17 may be formed on the inside of each first hinge wall 12 of the first hinge portion surrounding the opening 13, each latching groove 17 extending radially from the opening 13.

The latching ribs 16 and latching grooves 17 interact with each other in order to keep the hinge in a desired rotational position.

While the embodiment shown in the drawings has protrusions (latching ribs 16) on the second hinge portion and indentations (latching grooves 17) on the first hinge portion, this may also be vice versa. Also, other forms of protrusions and indentations may be used for obtaining the latching mechanism.

The sliding element 6 is slidingly received by the slide track 5 and can longitudinally move therein. In particular, the hinge, as described above, is designed and dimensioned such that it may also be received in the slide track 5. In order to be able to rotate the second portion 8 of the sliding element 6 (and thus the secondary lighting module 2*a*, 2*b* attached to it) with respect to the first portion 7 of the sliding element 6 (and thus the primary lighting module 1), the sliding element 6 must be moved along the slide track 5 so far that the second portion 8 and the hinge are located outside the slide track 5.

In order to prevent the sliding element 6 from fully leaving the slide track 5, a stopper protrusion 18 is provided at the innermost end 7' of the first portion 7 of the sliding element 6. The slide track 5 may be provided with a guiding track 19 for receiving and guiding the stopper protrusion 18 inside the slide track 5. The outermost end 5' of the slide track 5 may be provided with a cover 20 that prevents the stopper protrusion 18 from leaving the slide track 5. The cover 20 may be attached to the slide track 5 by means of screws 21. This stopper mechanism is shown in detail in the partially transparent view of FIG. 7. Instead of a separate cover, a protrusion in the guiding track 19 may prevent the stopper protrusion 18 from leaving the slide track 5.

A locking screw 22 may be provided in a threaded screw hole 23 in the housing. The locking screw 23 may be screwed against the sliding element 6 to prevent the sliding element 6 from moving along the slide track 5 in order to keep the sliding element 6 in a desired translational position with respect to the slide track 5.

The connecting module 4 also provides an electrical connection between the primary lighting module 1 and the respective secondary lighting module 2*a*, 2*b*. For this purpose, the connecting module 4 further comprises a cable 24, preferably including at least two conductive wires (for supply voltage and ground connection). One end of the cable 24 may be connected or connectable to the primary lighting module 1, the other end of the cable 24 may be connected or connectable to the secondary lighting module 2*a*, 2*b*.

The ends of the cable 24 may be fixedly connected to the primary lighting module 1 and secondary lighting module 2*a*, 2*b*, respectively. Alternatively, the end of the cable may be provided with plugs that may be connected to corresponding terminals on the primary lighting module 1 and the secondary lighting module 2*a*, 2*b*, respectively. It may also be considered that one end of the cable 24 may be fixedly connected to one of the primary lighting module 1 and the secondary lighting module 2*a*, 2*b*, and the other end of the cable 24 may be fixedly connected to the other of the primary lighting module 1 and the secondary lighting module 2*a*, 2*b*.

The cable 24 is preferably guided inside the connecting module 4. The cable 24 may be fixed to the connecting module 4, in particular to specific portions of the connecting module 4, using one or more fasteners 25*a*, 25*b*, 25*c*. The embodiment shown in the drawings uses three fasteners 25*a*, 25*b*, 25*c*, but any other number of fasteners may also be used. Each fastener 25*a*, 25*b*, 25*c* comprises a body fixedly attached to the cable, for example molded onto the cable 24, glued to the cable 24, or otherwise attached thereto. A groove 26 is provided in the body, running circumferentially around the cable 24 at least partially.

The fasteners 25*a*, 25*b*, 25*c* may be inserted in corresponding openings 27 in a wall of any of the components of the connecting module 4. The size and shape of the openings corresponds essentially to the size and shape of the groove 26, such that the groove 26 fits snugly into the opening while the portions of the body outside of the groove 26 abut the wall 27 in a flange-like manner, thus holding the fastener 25*a*, 25*b*, 25*c* in place.

In the embodiment shown in the drawings, a first fastener 25*a* is attached to the innermost wall 28 of the slide track 5, which is provided as a separate piece, in order to simplify assembly. A second fastener 25*b* is attached to an inner wall 31 of the first portion 7 of the sliding element 6. A third fastener 25*c* is attached to a wall (not shown) of the second portion 8 of the sliding element 6, in particular to the innermost wall of the second portion 8 between the second hinge walls 14.

Moving the pieces of the connecting module 4 with respect to each other requires the cable 24 to be adaptable to different lengths. The cable 24 may comprise two length varying sections. A first length varying section is provided as a helical cable portion 29. The helical cable portion 29 may be positioned between two of the fasteners 25*a*, 25*b*, 25*c*, for example between the first fastener 25*a* and the second fastener 25*b*. In this configuration, the helical cable portion 29 is adapted to compensate for translational movement of the sliding element 6 with respect to the slide track 5. The innermost end 7' of the first portion 7 of the sliding element 6 may be open to accommodate the helical cable portion 29 at least partially inside the first portion 7.

A second length varying section is provided as a retractable cable unit 30. The retractable cable unit 30 may be positioned between two of the fasteners 25*a*, 25*b*, 25*c*, for example between the second fastener 25*b* and the third fastener 25*c*. In this configuration, the retractable cable unit 30 is adapted to compensate for rotational movement of the second portion 8 of the sliding element 6 with respect to the first portion 7 of the sliding element 6. The retractable cable unit may be positioned inside the first portion 7 of the sliding element 6.

The outermost end of the cable may leave the second portion 8 of the sliding element 6 through a hole in the second portion 8.

The present invention also considers the use of a connecting module as disclosed herein for purposes other than connecting two lighting modules. A connecting module according to the present invention may also be used to connect other devices mechanically and electrically, while allowing for a flexible positioning of the devices with respect to each other.

Although the invention has been illustrated and described in detail by the embodiments explained above, it is not limited to these embodiments. Other variations may be derived by the skilled person without leaving the scope of the attached claims.

Generally, "a" or "an" may be understood as singular or plural, in particular with the meaning "at least one", "one or more", etc., unless this is explicitly excluded, for example by the term "exactly one", etc.

In addition, numerical values may include the exact value as well as a usual tolerance interval, unless this is explicitly excluded.

Features shown in the embodiments, in particular in different embodiments, may be combined or substituted without leaving the scope of the invention.

LIST OF REFERENCE NUMERALS

1 Primary lighting module
2*a* Secondary lighting modules

2*b* Secondary lighting modules
3 Diffusing cover
4 Connecting module
5 Slide track
5' Outermost end of slide track
6 Sliding element
7 First portion of sliding element
7' Innermost end of first portion
8 Second portion of sliding element
9 Eyelets
10 Screw holes
11 Screws
12 First hinge walls
13 Openings in first hinge walls
14 Second hinge walls
15 Openings in second hinge walls
16 Latching ribs
17 Latching groves
18 Stopper protrusion
19 Guiding track
20 Cover
21 Screws
22 Locking screw
23 Screw hole
24 Cable
25*a* Fastener
25*b* Fastener
25*c* Fastener
26 Groove
27 Opening
28 Innermost wall of slide track
29 Helical cable portion
30 Retractable cable unit
31 Inner wall
W1 Inner width of space between first hinge walls
W2 Outer width of second hinge portion

The invention claimed is:

1. A lighting device comprising:

a primary lighting module with one or more light sources; and at least one secondary lighting module with one or more light sources, wherein the at least one secondary lighting module is mechanically and electrically connected to the primary lighting module via a connecting module such that the at least one secondary lighting module is slidably movable and rotatably movable with respect to the primary lighting module, wherein the connecting module comprises:

a slide track; and a sliding element slidingly received by the slide track, the sliding element comprising:

a first portion; and a second portion rotatable relative to the first portion.

2. The lighting device of claim 1, wherein the sliding element and the slide track both comprise stoppers adapted to interact with each other in order to limit the range of relative movement between the primary lighting module and the at least one secondary lighting module.

3. The lighting device of claim 1, wherein the connecting module comprises a locking element for locking the sliding element with respect to the slide track.

4. The lighting device of claim 1, wherein the first portion of the sliding element and the second portion of the sliding element comprise corresponding latching elements for securing the relative rotational position between the first portion of the sliding element and the second portion of the sliding element.

5. The lighting device of claim 1, wherein the connecting module further comprises an electrical connector for providing an electrical connection between both ends of the connecting module, thereby providing an electrical connection between the sliding element and the slide track.

6. The lighting device of claim 5, wherein the electrical connector comprises a cable having at least one length varying section allowing longitudinal extension and retraction of the cable.

7. The lighting device of claim 6, wherein the length varying section comprises at least one of a helical cable portion and a retractable cable unit.

8. The lighting device of claim 5, wherein the electrical connector comprises one or more fasteners for fastening the electrical connector to at least one of the sliding element and the slide track.

9. The lighting device of claim 1, wherein the at least one secondary lighting module is movable between a collapsed state of the lighting device and an expanded state of the lighting device, wherein the primary lighting module and the at least one secondary lighting module are shaped such that the primary lighting module and the at least one secondary lighting module abut each other in the collapsed state of the lighting device without any gaps therebetween.

10. The lighting device of claim 1, wherein:

the second portion of the sliding element is attached to one of either the primary lighting module or the at least one secondary lighting module; and the slide track is attached to the other of either the primary lighting module or the at least one secondary lighting module.

11. The lighting device of claim 1, wherein the at least one secondary lighting module is slidably movable with respect to the primary lighting module such that:

in a first position of the first portion of the sliding element relative to the slide track, the second portion of the sliding element is prevented from rotating relative to the first portion of the sliding element; and in a different second position of the first portion of the sliding element relative to the slide track, the second portion of the sliding element is permitted to rotate relative to the first portion of the sliding element.

12. The lighting device of claim 1, wherein the first portion of the sliding element and the second portion of the sliding element are joined by a hinge portion which permits rotation of the second portion relative to the first portion.

13. The lighting device of claim 12, wherein:

in a first state of the connecting module, the hinge portion is at least partially positioned within the slide track such that the second portion of the sliding element is prevented from rotating relative to the first portion of the sliding element; and in a different second state of the connecting module, the hinge portion is at least partially positioned outside of the slide track such that the second portion of the sliding element is permitted to rotate relative to the first portion of the sliding element.

14. The lighting device of claim 1, further comprising a first driver hosted by the primary lighting module and configured to drive at least the one or more light sources of the primary lighting module.

15. The lighting device of claim 14, wherein:

the first driver is configured to drive the one or more light sources of the primary lighting module; and the lighting device further comprises a second driver hosted by the at least one secondary lighting module and configured to drive the one or more light sources of the at least one secondary lighting module.

16. A lighting device comprising:

a first lighting module comprising a first light source;

a second lighting module comprising a second light source; and a connecting module connecting the second lighting module to the first lighting module such that the second lighting module is slidably movable and rotatably movable with respect to the first lighting module, wherein the connecting module comprises:

a slide track; and a sliding element slidingly received by the slide track;

wherein electrical connection between the first lighting module and the second lighting module is provided by a cable at least partially situated within the connecting module and adapted to compensate for translational movement and rotational movement of the second light module relative to the first lighting module.

17. The lighting device of claim 16, wherein the connecting module permits rotation of the second lighting module in a manner which adjusts at least one of a convergence and a divergence of an output of the lighting device.

18. The lighting device of claim 16, wherein the sliding element includes a hinge portion which permits rotation of the second lighting module relative to the first lighting module in a manner which adjusts at least one of a convergence and a divergence of an output of the lighting device.

19. The lighting device of claim 16, wherein:

the slide track is fixedly provided at the first lighting module; and the sliding element is fixedly provided at the second lighting module.

20. The lighting device of claim 16, wherein:

the slide track is fixedly provided at the second lighting module; and the sliding element is fixedly provided at the first lighting module.

21. The lighting device of claim 16, wherein the lighting device comprises a plurality of second lighting modules, wherein the plurality of second lighting modules are at least one of slidably movable and rotatably movable with respect to the first lighting module in an individual or independent manner.

22. The lighting device of claim 16, wherein the lighting device comprises a plurality of second lighting modules, wherein the plurality of second lighting modules are at least one of slidably movable and rotatably movable with respect to the first lighting module in a synchronized or simultaneous manner.

23. The lighting device of claim 16, wherein the first lighting module hosts an electronic driver configured to drive both the first light source and the second light source.

24. The lighting device of claim 16, wherein:

the first lighting module hosts a first electronic driver configured to drive the first light source; and the second lighting module hosts a second electronic driver configured to drive the second light source.

* * * * *